United States Patent [19]

Elliott et al.

[11] Patent Number: 4,892,411

[45] Date of Patent: Jan. 9, 1990

[54] ASPHALT MIXER APPARATUS AND METHOD

[76] Inventors: E. J. Elliott, Altamonte Springs, Fla.; Fred W. Prill, North Aurora; Douglas R. Fisher, East Dundee, both of Ill.

[21] Appl. No.: 153,459

[22] Filed: Feb. 8, 1988

[51] Int. Cl.[4] ..... B28C 5/46

[52] U.S. Cl. ..... 366/25; 366/40; 366/144; 366/228; 366/229; 366/231; 432/106; 432/111; 34/131; 34/137

[58] Field of Search ..... 362/4, 7, 9.12, 14, 362/20, 22, 27, 30–35, 38, 40, 45, 46, 54–59, 144, 228; 432/106, 113, 108, 111, 117; 34/131, 132, 137, 140; 110/226; 366/229–231, 220, 225

[56] References Cited

U.S. PATENT DOCUMENTS

| | | | |
|---|---|---|---|
| 1,836,754 | 12/1931 | Hepburn | 366/25 |
| 3,091,369 | 5/1963 | Sackett, Jr. | 366/26 |
| 3,840,215 | 10/1974 | McConnaughay | 366/25 |
| 3,866,888 | 2/1975 | Dydzyk | 366/25 |
| 3,883,959 | 5/1975 | Neville | 432/113 |
| 4,175,869 | 11/1979 | Chunland | 366/42 |
| 4,190,370 | 2/1980 | Brock et al. | 366/25 |
| 4,191,530 | 3/1980 | Bearce | 432/113 |
| 4,207,062 | 6/1980 | Moench et al. | 366/25 |
| 4,229,109 | 10/1980 | Benson | 366/24 |
| 4,298,287 | 11/1981 | McCarter, III et al. | 366/25 |
| 4,332,478 | 6/1982 | Binz | 366/25 |
| 4,342,554 | 8/1982 | Rohrbach | 432/106 |
| 4,395,129 | 7/1983 | Musil | 566/25 |
| 4,522,498 | 6/1985 | Mendehall | 566/25 |
| 4,555,182 | 11/1985 | Mendehall | 366/23 |
| 4,616,934 | 10/1986 | Brock | 366/25 |
| 4,787,938 | 11/1988 | Hawkins | 432/14 |

*Primary Examiner*—Harvey C. Hornsby
*Assistant Examiner*—Joseph S. Machuga
*Attorney, Agent, or Firm*—William M. Hobby, III; Hobby, Wiggins & Beusse

[57] ABSTRACT

The present invention relates to a continuous drum dryer mixer apparatus and method for heating and drying virgin aggregates, as well as recycled asphaltic pavement materials and mixing such materials with liquid asphalt cement and other ingredients to formulate asphalt paving materials.

A first cylindrical rotatable drum dryer has a first material input in one end thereof and a material output at the other end thereof. The output is directable at the option of the operator to either a hot elevator for carrying it to an asphalt batch plant or into a second concentric or offset rotating drum mixer. A burner is mounted either at the output end of the first cylindrical drum, or at the output end of the second drum and extends therethrough to the output end of the first cylindrical drum for directing a flame into the first cylindrical drum. A liquid asphalt injection nozzle introduces liquid asphaltic materials into the second cylindrical drum Mixer for mixing with dried aggregates and recycled asphaltic materials. The device also includes a first suction device which cooperates with two annular plates to prevent smoke and fines from passing from the mixing drum to the heating and drying drum. A cowling, fan and connecting pipe are used to recirculate the hot exhaust gases back to the burner.

10 Claims, 2 Drawing Sheets

ASPHALT MIXER APPARATUS AND METHOD

BACKGROUND OF THE INVENTION

The present invention relates to a concept of providing a combination means of feeding, heating and drying virgin aggregates and, at the option of the operator, having the heated virgin aggregate directed to a batch plant tower for batch mixing, or in the alternative, to a continuous drum mixer where recycled asphaltic pavement, liquid asphalt cement, fillers and other additives may be blended in the preparation of asphalt paving materials. In the past, asphalt plants have generally been of two types, the Batch type, and more recently the Drum Mix type. Batch type plants typically have hopper feeders for feeding different sizes of unweighed cold aggregate materials by means of a cold feed conveyor into the dryer. The dryer typically involves a large elongated drum having a burner directed into one end, with the aggregate being fed therethrough from the other end, and providing rotation of the drum with flights for lifting the aggregate material and dropping it through the hot gases and causing it to be dried. As the material flows through the drum, toward the burner, the hot air and gases flow in the opposite direction to the flow of materials (counter flow) exiting out of the other end of the dryer into a ducting system which is directed towards a wet wash, mechanical collector, or fabric filter dust collector for cleaning the air and gases prior to their discharge from a stack. Meanwhile, the dried aggregate materials are fed up a bucket type hot elevator to a batching tower, where the material is passed through screens for separating it into sizes and storing it into separate compartments whence it is withdrawn pursuant to various formulas into the weigh box. After weighing, the aggregates are dropped into a mixer at the bottom of the tower where the exact amount of hot liquid asphalt is added, along with mineral fillers, and limited amounts of recycled asphaltic materials and mixed to specified time durations, prior to loading into a truck. This type of plant has been the most commonly used around the world, but has the disadvantage of being able to process only limited amounts of recycled asphaltic pavement materials, with substantial environmental problems, and at a higher production cost than a Drum Mixer.

The other concept of asphalt production, The Drum Mix Plant, has a feed system which preproportions the ratios, or actually weighs in motion, the various aggregates onto the cold feed conveyors, feeds it into a rotating elongated drum dryer, where a burner is directed into the same end as the cold aggregates, (Parallel Flow). As the aggregates tumble and progress through the rotating drum dryer, progressively away from the burner, they absorb heat and shed moisture. As aggregates progress into the drum, at some point therein liquid asphalt is injected which mixes with the aggregates through the tumbling action and exit the dryer discharge as a finished mixture ready to be loaded into trucks for hauling to the paving site. This type of drum mix plant is most commonly used to process larger ratios of recycled asphaltic pavement (RAP) which is introduced into the elongated drum dryer at some point prior to injection of the liquid asphalt materials. The disadvantage of this drum mix plant is that both the liquid asphalt, as well as the recycled asphaltic pavement, are introduced into the same single elongated drum dryer into which the intense fire is released from the burner, and subjected to the high velocity, and elevated temperatures of the plant exhaust system. The high temperature from the flame and combustion gases cause burning of the liquid asphalt, degradation of quality of the finished product, release of volatiles from the liquid asphalt, as well as the recycled asphaltic pavement materials, generation of blue smoke and other severe pollutants, release of odors, and also can cause fires and explosions from the gasified volatiles which tend to recondense into liquid form in the fabric filters of the exhaust system.

Prior U.S. Pat. No. 4,262,429 deals with a method of and apparatus for drying materials which uses coaxial cylinders with one being fed moist fine aggregates and the other being fed moist coarse aggregates for mixing and drying the aggregates. It does not deal with the manufacture of paving asphalt nor the use of recycled asphalt and does not provide the pollution reduction (for asphalt plants) accomplished with an exhaust feedback loop and dust collection chamber.

The present invention is directed to an asphalt plant which can process a mixture of recycled asphalt and virgin materials or can process only virgin materials without oxidizing, distilling or burning the liquid asphalt, or that of the recycled asphaltic paving material, and without releasing volatile matter, particulate pollutants, or odors. It utilizes the energy-efficient Counterflow process to dry the materials in the drying section of the rotating drum. After heated and dried materials pass the position of the burner they enter into the mixing, rotating drum where liquid asphalt, as well as recycled asphaltic materials and mineral fillers are introduced to blend with the heated virgin materials and mix in a static environment. Thus, the asphaltic components of the mix do not sustain degradation due to the temperatures of the burner gases, nor does it allow for contamination of the exhaust system with gasified or liquid constituents of asphalt, asphaltic odors, recondensing petroleum vapors, or particulate emmissions from the mineral fillers. Any vapors generated in the static environment of mixer section are withdrawn and fed into the adjacent burner where they are incinerated while enriching the fuel of the burner.

It is accordingly an aim of the present invention to provide an aggregate and virgin asphalt plant which can utilize recycled asphalt materials and produce a superior product utilizing substantial amounts of normally wasted energy, and dramatically reduce release of environmental pollutants, as well as reduce fire and explosion hazards.

In U.S. Pat. No. 4,600,379 for a drum heating and mixing apparatus and method, a combination direct and indirect fired drum heating and mixing apparatus is provided for the same purposes as the present invention. The present invention is an improvement over this heating and mixing apparatus which has a concentric outer drum mounted around an inner drum and has an aggregate input from the material output of the inner drum and an aggregate output therefrom at the other end of the outer drum so that aggregate material can pass through the inner drum and then pass between the inner and outer drums. A burner mounted at one end of the inner cylindrical drums directs a flame thereinto for drying an aggregate. An exhaust gas feedback siphons vapors and gases emitted in the space between the two drums back into the flame for incineration through the system burner. An asphalt cement injection nozzle injects asphalt cement into the aggregates passing through the concentric outer drum while a second aggregate feed can direct recycled asphalt pavement material into the concentric outer drum. In contrast to this drum heating and mixing system, the present invention directs the aggregates through the equivalent of a prior center drum and into a second drum mounted concentric but behind the center drum for receiving a direct pass through the aggregates. The second concentric drum can be separately attached to the first drum or rotated individually.

In addition to this patent, the prior U.S. Pat. to Rohrbach, No. 4,342,554, shows the production of expanded clay and shale which uses a larger drum placed behind a smaller angled rotating drum. The Maeda, et al, Pat. No. 4,462,793, is for a calcining lime system and the Drugge Pat. No. 4,168,951 is for a cintering apparatus, while the Cnare Pat. No. 4,367,065 is for drawing coal. Each of these patents show burners used for different purposes but having rotating drums angled toward the flame which feed the material being dried in one end toward the flame. The Labriot, et al, Pat. No. 4,286,944, feeds material past a center burner in one of its embodiments. The Deckebach Pat. No. 4,439,141, shows another related apparatus. The present invention is an improvement over my prior drum heating and mixing apparatus and method as taught in U.S. Pat. No. 4,600,379 and provides for the easy addition of a second drum positioned outside of the flame to receive the dry aggregate from the drum having the burner therein so that the mixing takes place outside of the flame.

SUMMARY OF THE INVENTION

The present invention relates to a continuous drum dryer mixer apparatus and method for heating and drying virgin aggregates, as well as recycled asphaltic pavement materials and mixing such with liquid asphalt cement in the preparation of asphalt paving materials. A first cylindrical rotatable drum has a first material input in one end portion thereof and a material output at the other end thereof into a second concentric or offset drum mounted adjacent the material output end of the first cylindrical drum and attached thereto and having the material input from the material output of the first cylindrical drum and a material output therefrom at the other end thereof so that materials passing through the first cylindrical drum will passes directly, or indirectly into the second cylindrical drum. The dried aggregates can optionally be discharged to the tower of a batching plant or moved into a second drum for mixing with liquid asphalt. A burner is mounted behind the second drum and extends therethrough to one end of the first cylindrical drum for directing a flame into the first cylindrical drum. A liquid asphalt injection nozzle means introduces liquid asphaltic materials into the mixing area of the second cylindrical drum for mixing with dried aggregates and recycled asphaltic materials so that aggregate move from the inlet end of the drum towards the burner end into the second cylindrical drum and the mixing of the liquid asphalt and reclaimed asphaltic material are mixed in the second concentric cylindrical drum.

A method of producing asphaltic pavement materials includes the steps of feeding aggregate materials to a first rotating drum while directing a burner flame into the first drum for heating aggregate materials fed thereinto. The aggregate materials from the first cylindrical drum are directed to a second cylindrical drum either attached or totally or partially detached from to first cylindrical drum. Used asphaltic materials are fed to the second drum for mixing with aggregate materials being fed from the first drum and an asphalt cement and other additives fed onto the mixture of aggregates and used asphaltic materials which are then mixed together for use as a paving material.

BRIEF DESCRIPTION OF THE DRAWINGS

The present invention will be apparent from the written description and the drawings in which.

DESCRIPTION OF THE PREFERRED EMBODIMENT

Figure 1:
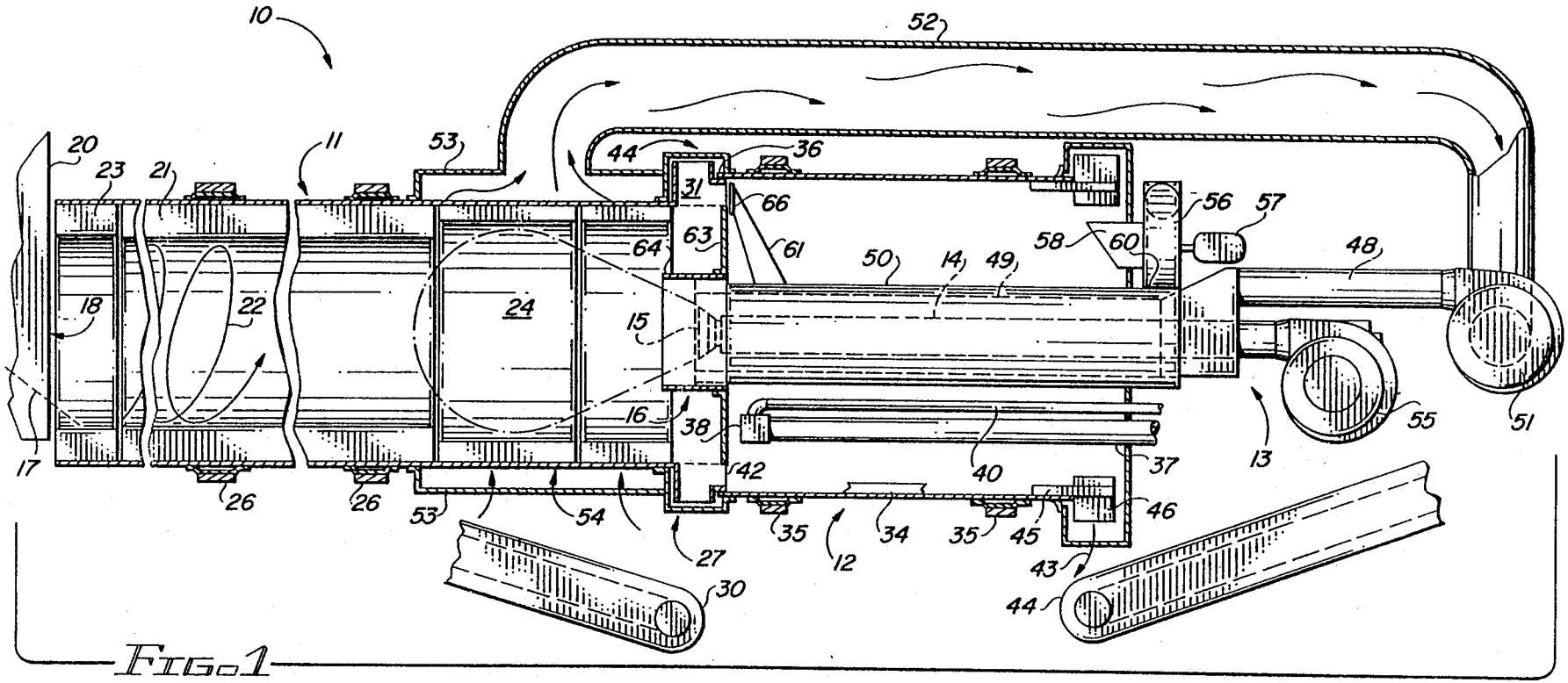
FIG. 1 is side sectional view of an asphalt mixer in accordance with the present invention.
Figure 4:
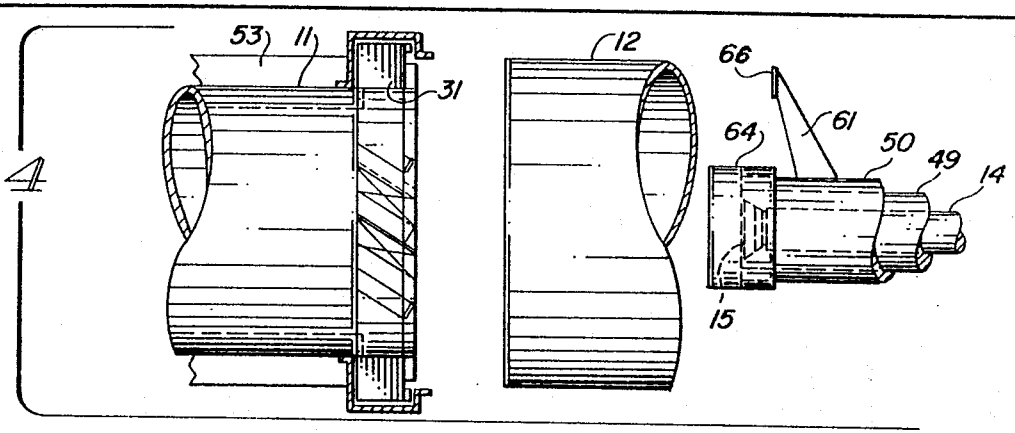
FIG. 4 is a partially exploded elevation of the asphalt mixer in accordance with FIG. 1.
Figure 3:
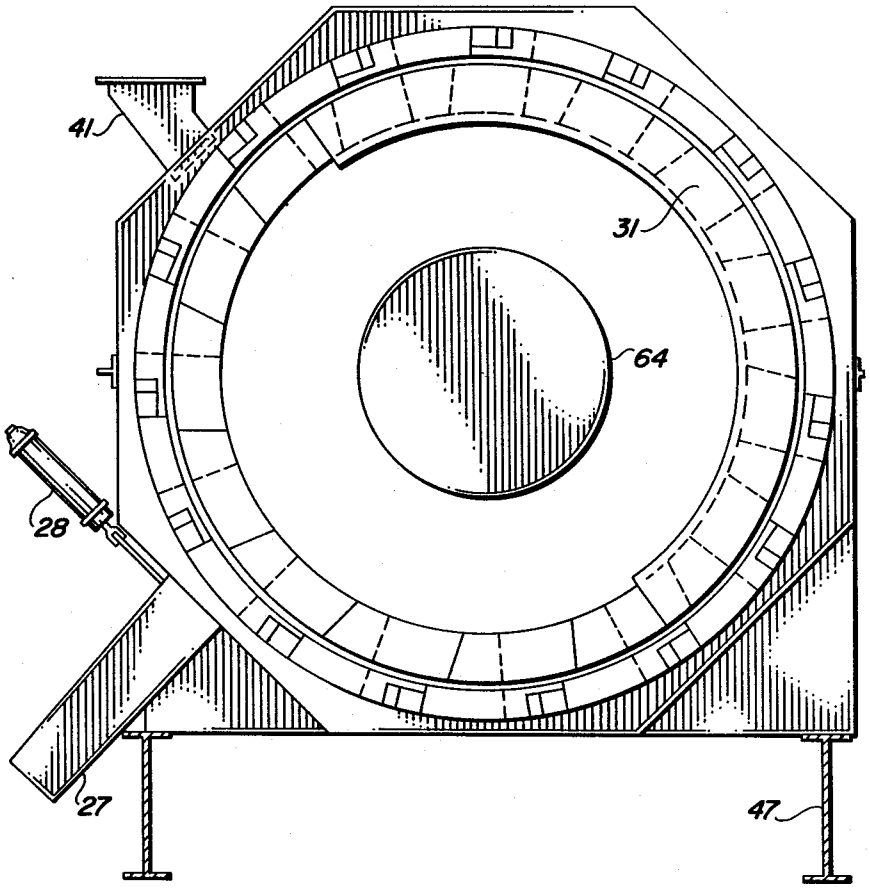
FIG. 3 is a sectional view of the asphalt mixer in accordance with claim 1 taken through the burner housing behind the nozzle.
Figure 2:
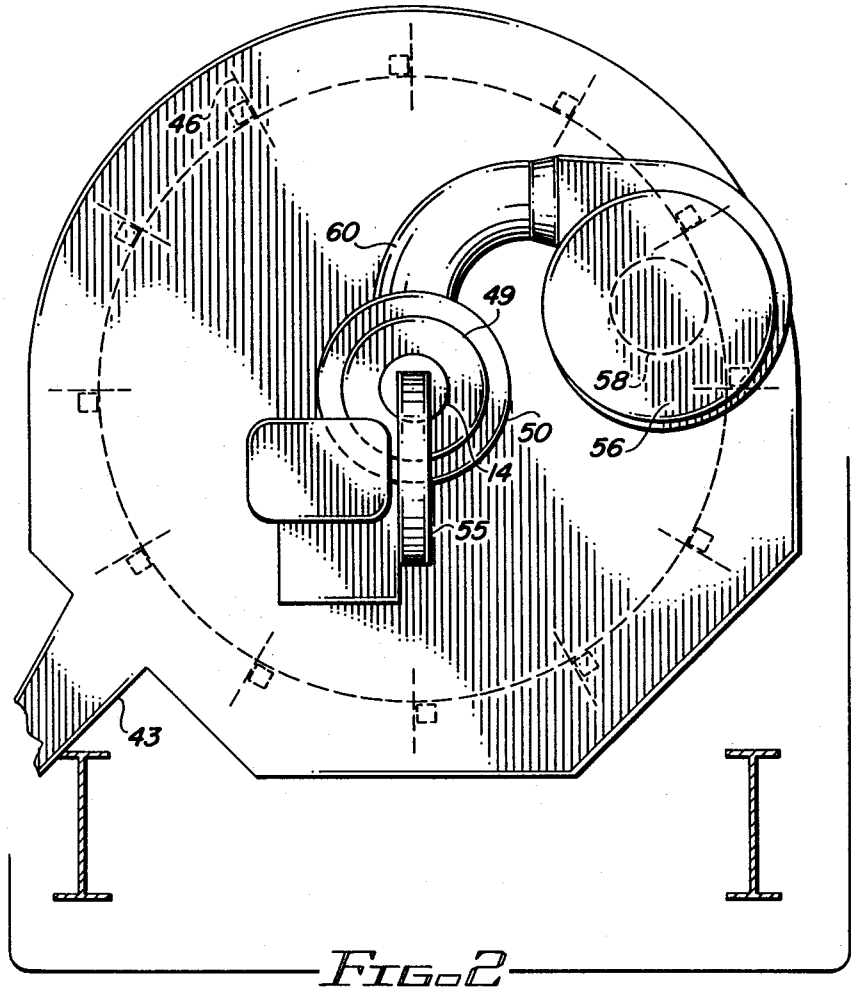
FIG. 2 is a rear end elevation of the asphalt mixer in accordance with FIG. 1.

Referring to the drawings, FIGS. 1 through 4, a drum drying and mixing apparatus 10 is shown for heat drying aggregates only or for drying aggregates and mixing the dried aggregates with liquid asphalt, recycled asphalt materials and with aggregate fines for producing dried aggregates or asphalt paving materials. The apparatus 10 has a first heat drying drum 11 and a second mixing drum 12. An industrial burner 13 is located behind the drum 12 and has an extension 14 extending through the drum 12 to place the nozzle portion 15 at the end 16 of the drum 11. Aggregates are fed into a virgin aggregate inlet 17 adjacent the drum 11 end 18 and adjacent the exhaust stack 20. The drum 11 has a plurality of flights 21 therein for lifting the aggregates 22 being fed therethrough for discharge into the heated air in the drum 11. The Flights are partially shown but may be seem more clearly in prior U.S. Pat. Nos. 4,189,300 and 4,262,429. Smaller flights 23 are used to feed the aggregates 22 from the aggregate inlet 17 into the drum 11 where the rotation of the drum 11 with the flights 21 lifts and moves the aggregates therethrough towards the flame 24 from the nozzle 15 of the burner 13. The drum 11 may typically be tilted downward from the end 18 towards the end 16 so that gravity also moves the aggregates through the drums 11 and 12. The aggregate drying drum 11 may already be in operation and has its utility expanded by the addition of the mixing drum 12 which can be attached to existing drying drums. The drum 11 has a pair of annular tracks 26 mounted therearound for rotating the drum upon when drying aggregates and a discharge 27 which can be opened or closed by the hydraulic cylinder 28 to direct the hot, dried aggregates either onto the belt conveyor elevator 30 or into the mixing drum 12. Mixing discharge blades 31 move the aggregate out the discharge open 27 when in an open position and into the mixing drum 12 when in a closed position. A set of smaller flights 32 and 33 feed the aggregate into the blades 31.

The mixing drum 12 has a plurality of mixing flights 34 mounted therein for lifting and mixing the aggregates and other materials being fed into the drum 12. A pair of annular tracks 35 are mounted around the drum 12 for rotating the drum therearound similar to the tracks 26 and may be driven by a separate drive or the same drive used for rotating the drum 11. The drums are connected by welding the drums together or by bolts 36 and thus always rotate together. An aggregate fines screw conveyor 37 feeds fines through an outlet nozzle 38 into the mixing drum 12 and a liquid asphalt inlet pipe 40 feeds liquid asphalt into the nozzle 38 with the fines from the fines inlet conveyor 37 and into the mixer drum 12. The nozzle 38 is positioned adjacent the front end of the drum 12 to begin mixing with the hot aggregate being fed thereinto from the drum 11. Recycled asphaltic materials can be fed into the mixing drum 12 through an opening 41 into the blades 31 and then into the mixing drum 12 with the hot aggregates through the passageway 42. The mixed aggregates, liquid asphalt, fines and recycled asphaltic materials are discharged through a discharge outlet 43 onto a hot mix discharge conveyor 44 to a surge silo. A set of flights 45 delivers the mixture to the discharge blades 46 which push the mixture out the discharge opening 43.

The burner 13 is fixedly supported on the legs 47 and has the main burner body 48 connected to the burner nozzle extension 14 and 49 and to the nozzle 15. The burner extension 14 is enclosed in a cylindrical housing 50 for protecting the burner extension from the hot asphalt mix and to allow the burner to be easily removed from the drums for adjustments or repair. The burner 13 has an air fan 51 being fed heated input air from an air inlet pipe 52 which is connected to a cowling 53 fixedly attached to surround the rotating drum 11 around the area of the flame 24 inside the drum 11. The air inlet 54 is on the bottom of the cowling 53 so the air is pulled around the rotating and heated drum 11 where the air is heated as it is fed into the air pipe 52 and into the burner 13. The burner main fan 55 draws the air thereinto and to the nozzle area 15 for mixing with the fuel. A scavenger fan 56 is mounted to the burner 13 and is driven by a separate motor 57 and had an inlet pipe 58 connected to the top part of the drum 13 to draw of smoke and other fine solid particles in the mixing drum and feeds the particles into the burner at 60 and back into the flame 24 to be incinerated and reduce the exhaust discharge of solids from the mixer.

The drum 12 has a fixed support bracket 61 fixedly mounted to the cover 50 and supporting an arcuate plate 66 which extends part way around the annular opening 42 to block the entrance of materials through a portion of the opening and the escape of smoke, fumes and fine solids from the mixing drum. The bottom portion of the opening 42 is blocked by the solid aggregates and recycled asphaltic materials being fed therethrough and by the slight negative pressure from the scavenger fan 56. An annular plate 63 is attached to the nozzle shielding cover 64 and blocks the passage of materials in either direction.

It should be clear at this point that a system for drying aggregates can also be used with recycled asphaltic materials and with liquid asphalt to mix hot asphalt for use in paving and the like. The drum drier mixer has the flame applied directly to the drying drum for heating virgin aggregates but avoid applying the direct flame to the recycled materials and liquid asphalt injected into the mixture. The mixture is mixed in the mixing drum which has the heated aggregates fed directly into the mixing drum complete with the heat therein and the inlet air is preheated by the drying drum which also helps heat the mixing drum. The dust, and blue smoke, are recovered and recycled through the burner to reduce pollution and increase the efficiency of the system. The present invention, however, is not to be considered limited to the forms shown which are to be considered illustrative rather than restrictive.

I claim:

1. Drum heating and mixing apparatus comprising:

a first cylindrical rotatable drum having a first material input in one end portion thereof and a material output at the other end thereof;

a second concentric drum mounted adjacent the material output end of the first cylindrical drum and attached thereto and having the material input from the material output of the first cylindrical drum and a material output therefrom at the other end thereof so that materials passing through the first cylindrical drum will pass into the second cylindrical drum;

a burner mounted on one end of said second cylindrical drum and extending therethrough for directing a flame into the first cylindrical drum;

a cowling mounted around a portion of the outside of said first cylindrical rotatable drum forming a passageway for air intake therearound and said cowling being connected to the burner air intake whereby heated air is fed to said burner;

means for introducing reclaimed asphaltic pavement materials into the mixing area of the second cylindrical drum; and means for introducing liquid asphalt into the mixing area of the second cylindrical drum, whereby aggregate enters from the output end of the first cylindrical drum into the second cylindrical drum for the mixing of the liquid asphalt and reclaimed asphaltic materials;

a scavenger blower coupled between said second concentric drum and said burner for capturing smoke and particles from said second concentric drum and feeding said smoke and particles into said burner for incineration; and means for switching the dried heated virgin aggregates between an elevator, and said second cylindrical mixing drum.

2. A drum heating and mixing apparatus in accordance with claim 1 in which said the cowling around said first cylindrical rotatable drum is connected by a air pipe to said burner air intake through a burner blower.

3. A drum heating and mixing apparatus in accordance with claim 2 in which said means for switching said dried heated virgin aggregates to on elevator includes a fluid actuated cylinder for opening and closing a discharge from said first cylindrical drum.

4. A drum heating and mixing apparatus in accordance with claim 3 in which said second drum has means to block smoke and solid particulate matter from escaping from the aggregate entrance thereto.

5. A drum heating and mixing apparatus in accordance with claim 4 in which said means to block smoke and solid particulate matter from escaping from the aggregate entrance thereto includes an annular plate mounted to block a portion of the annular opening for receiving aggregates thereinto.

6. A drum heating and mixing apparatus in accordance with claim 5 in which said means to block smoke and solid particulate matter from escaping from the aggregate entrance thereto includes a second annular plate mounted to said burner to block the center portion of the annular opening into said second cylindrical drum.

7. A drum heating and mixing apparatus operatively coupling a virgin aggregate drum heating and drying apparatus having a burner connected thereto to a drum mixing apparatus for mixing heated dried virgin aggregate with liquid asphaltic materials comprising:

a virgin aggregate heating and drying drum having a burner connected thereto;

a mixing drum mountable to the material output end of said aggregate heating and drying drum, said mixing drum having an output therefrom for discharging mixed asphalt paving materials;

means for rotating said mixing drum connected to said mixing drum;

means for coupling said mixing drum to said virgin aggregate heating and drying drum and for accepting heated virgin aggregate therefrom;

means for introducing reclaimed asphaltic pavement materials into the mixing area of the mixing drum;

scavenger means for capturing smoke and fine solid particles in said mixer drum and feeding said captured smoke to said burner of said virgin aggregate heating and drying drum for incinerating said smoke and fine solids;

means for blocking said smoke and fine solid particles from escaping said mixing drum through said heated and dried aggregate entrance into said mixing drum, said means to block smoke and solid particulate matter from escaping from the aggregate entrance of said mixing drum includes an annular plate mounted to block a portion of the annular opening for receiving aggregates thereinto;

means for introducing liquid asphalt into the mixing drum, whereby heated aggregate from an aggregate heating and drying drum enters the mixing drum and is mixed with liquid asphalt and reclaimed asphaltic materials; and means for switching said dried heated virgin aggregates to a conveyor or to said mixing drum; whereby said drum mixing apparatus can selectively mix the heated dried virgin aggregate with liquid asphaltic material.

8. A drum mixing apparatus in accordance with claim 7 including a rotatable drying drum cowling is mountable around a portion of the outside of said drum forming a passageway for air intake therearound and said cowling is connected to the burner air intake whereby heated air is fed to said burner.

9. A drum mixing apparatus in accordance with claim 8 in which said cowling around said rotatable drying drum is connected by an air pipe to said burner air intake through a burner blower.

10. A drum mixing apparatus in accordance with claim 9 in which said means to block smoke and solid particulate matter from escaping from the aggregate entrance of said mixing drum includes a second annular plate mounted to said burner to block a portion of the annular opening into said mixing drum.

* * * * *